US009228555B2

(12) United States Patent
Tung et al.

(10) Patent No.: US 9,228,555 B2
(45) Date of Patent: Jan. 5, 2016

(54) ENGINE IGNITION CONTROL DEVICE

(75) Inventors: Yu-Chia Tung, Kaohsiung (TW); Shih-Chia Hsieh, Kaohsiung (TW); Kun-Lang Lu, Kaohsiung (TW)

(73) Assignee: KWANG YANG MOTOR CO., LTD, Kaohsiung (TW)

( * ) Notice: Subject to any disclaimer, the term of this patent is extended or adjusted under 35 U.S.C. 154(b) by 559 days.

(21) Appl. No.: 13/600,360

(22) Filed: Aug. 31, 2012

(65) Prior Publication Data

US 2013/0055992 A1 Mar. 7, 2013

(30) Foreign Application Priority Data

Sep. 1, 2011 (TW) ..... 100131466 A

(51) Int. Cl.

| | |
|---|---|
| ***F02P 3/05*** | (2006.01) |
| ***F02P 3/00*** | (2006.01) |
| ***F02N 11/10*** | (2006.01) |
| ***F02P 1/08*** | (2006.01) |

(52) U.S. Cl.

CPC ..... *F02N 11/101* (2013.01); *F02P 1/08* (2013.01)

(58) Field of Classification Search

CPC ..... F02D 41/402; F02P 3/005; F02P 7/10; F02P 11/06; F02P 17/12; F02P 23/04; F02P 2017/121

USPC .... 123/143 R, 146.5 R, 149 A, 198 DC, 594, 123/622, 623, 630, 632, 644, 652; 324/378; 315/209 T, 291, 307

See application file for complete search history.

(56) References Cited

U.S. PATENT DOCUMENTS

| | | | | |
|---|---|---|---|---|
| 4,343,285 | A * | 8/1982 | Brammer et al. | 123/647 |
| 4,367,712 | A * | 1/1983 | Sugiura | 123/406.53 |
| 5,664,550 | A * | 9/1997 | Ito et al. | 123/630 |
| 6,539,929 | B2 * | 4/2003 | Ito et al. | 123/630 |
| 7,013,882 | B2 * | 3/2006 | Long et al. | 123/609 |
| 2004/0084034 | A1 * | 5/2004 | Huberts et al. | 123/630 |
| 2004/0094120 | A1 * | 5/2004 | Kishibata et al. | 123/325 |
| 2004/0102704 | A1 * | 5/2004 | Tsujita et al. | 600/443 |
| 2006/0000460 | A1 * | 1/2006 | Masters et al. | 123/609 |
| 2010/0237126 | A1 * | 9/2010 | Matsunaga et al. | 227/8 |

FOREIGN PATENT DOCUMENTS

| | | |
|---|---|---|
| JP | 2002339847 | 11/2002 |
| TW | 104401 | 5/1999 |
| TW | I300821 | 1/2008 |
| TW | I344430 | 6/2010 |

* cited by examiner

*Primary Examiner* — John Kwon
*Assistant Examiner* — Johnny H Hoang
(74) *Attorney, Agent, or Firm* — WPAT, PC; Justin King

(57) ABSTRACT

An engine ignition control device includes: a pulser; and a control unit, which includes a micro control unit (MCU) and a printed circuit board (PCB). The PCB is electrically connected to the micro control unit, wherein the PCB includes a back porch signal generating circuit. The back porch signal generating circuit is electrically connected to the micro control unit, and includes a bipolar junction transistor (BJT). Emitter (E) of the bipolar junction transistor is electrically connected to the pulser, collector (C) of the bipolar junction transistor is electrically connected to the micro control unit, and base (B) of the bipolar junction transistor is increased to a predetermined voltage level that is larger than 0V.

5 Claims, 7 Drawing Sheets

ENGINE IGNITION CONTROL DEVICE

CROSS-REFERENCE TO RELATED APPLICATION

This application claims the benefit of Taiwan Patent Application No. 100131466, filed on Sep. 1, 2011, which is hereby incorporated by reference for all purposes as if fully set forth herein.

BACKGROUND

1. Field of the Invention

The present invention relates to an ignition control device, and more particularly to an ignition control device of an engine starting system.

2. Related Art

Motorcycles are popular owing to their speed and degree of flexibility. To activate the motorcycle, both fresh air introduced from the outside and fuel are delivered to a carburetor and mixed together to form oil gas; then, the oil gas is transmitted into the engine, causing deflagration and creating dynamics to achieve the reciprocating movement of piston, thereby activating the transmission system; the rotation of the back wheels are driven by the transmission system, and the rotation of the front wheels are driven synchronously with the rotation of the back wheels; this allows the motorcycle to move forward. When the motorcycle is stopped briefly, the engine may be restarted easily after a short period of time. However, if the motorcycle is stopped for too long (generally called a cold engine), it is more difficult to start the engine when it is cold.

Referring to FIG. 1, Taiwan Patent Application No. I300821 disclosed an engine starting system 7. The engine starting system 7 includes a power unit 71, a main switch lock 70, and a sensor 72. The power unit 71 (such as a storage cell) is used for providing electrical potential and current to the whole engine starting system 7 of the motorcycle. The engine starting system 7 further includes a motor control device 73 and an ignition control device 75, wherein the motor control device 73 is used to drive a crankshaft (not shown) of the engine to rotate, and the ignition control device 75 is used to initiate the spark plug, thereby allowing the engine to continue operate by itself. The main switch lock 70 is electrically connected to the power unit 71, the motor control device 73, and the ignition control device 75. The sensor 72 is electrically connected to the main switch lock 70 and the ignition control device 75, and is electrically connected to the power unit 71 through an electrified switch 78. A sensing member 74 (such as a chip card) may be sensed by the sensor 72, thereby switching the main switch lock 70.

The motor control device 73 includes a brake lever indicator switch 731, a starting switch 733, a relay 737, and a starting motor 739. Excitation coil 735 of the brake lever indicator switch 731, the starting switch 733, and the relay 737 are serially connected to each other. A set of electrical contact points 738 of the relay 737 is electrically connected to the power unit 71 and the starting motor 739. When the brake lever indicator switch 731 and the starting switch 733 are both under conducting state, the excitation coil 735 of the relay 737 is excited, thereby activating the relay 737; whereby, the set of electrical contact points 738 will be under conducting state, allowing the power unit 71 to supply electrical power to the starting motor 739, and thereby allowing the starting motor 739 to rotate, and then driving the crankshaft of the engine to rotate.

The ignition control device 75 includes a capacitive discharge ignition (CDI) 751, a high-voltage coil 753, a spark plug 755, and an ignition signal generator 757. Wherein, the capacitive discharge ignition 751, the high-voltage coil 753, and the spark plug 755 are electrically serial-connected to each other, and the ignition signal generator 757 is electrically connected to the capacitive discharge ignition 751 in order to control the conducting time of the capacitive discharge ignition 751, thereby generating a high voltage from the high-voltage coil 753 and supplying electrical power to the spark plug 755; thus, the spark plug 755 generates an electric arc and is ignited, allowing the engine to continue the rotation by itself. The ignition signal generator 757 includes an alternating current generator (ACG) 7571 and a pulser 7573. When the engine rotates, the alternating current generator 7571 is driven to generate electrical power and transmit the electrical power to the pulser 7573. The pulser 7573 then controls the capacitive discharge ignition 751, thereby generating a high voltage from the high-voltage coil 753 and supplying electrical power to the spark plug 755; thus, the spark plug 755 generates an electric arc and is ignited.

Referring to FIG. 2, Taiwan Patent Application No. I344430 disclosed an engine structure for motorcycles. Crankshaft 81 is disposed with a flywheel 82 and a pulser 83 at the left crankshaft box thereof, wherein a bump 821 is disposed on the flywheel 82. When the crankshaft 81 rotates and drives the flywheel 82, the bump 821 is induced using the pulser 83, thereby transmitting signal from the pulser 83 to the capacitive discharge ignition, and then the capacitive discharge ignition may allow the ignition action to be performed in the spark plug.

Referring to FIG. 3, Taiwan Patent Application No. 104401 disclosed a traditional ignition device 91 (such as a capacitive discharge ignition (CDI) or a transistorized coil ignition (TCI)), a low voltage power supply 93, capacitors 96, 98, diodes 90, 92, and an electric resistor 94. The traditional ignition device 91 provides the high voltage required for allowing the gas/oil mixture at the gap of the surface 971 of a traveling spark ignition (TSI) 97 to break down or ionize (magnetic field acting increases plasma volume).

The three prior arts mentioned above all lack disclosure described as follows. When the starting motor is activated under low temperature, voltage generated by the pulser of the alternating current generator is lower than the voltage generated by pulser under normal temperature. Further, voltage at the back porch of the pulser is slightly lower than voltage at the front porch of the pulser. When voltage at the back porch of the pulser is lower than 1.2V, bipolar junction transistor (BJT) of the circuit at the back porch of the capacitive discharge ignition may not be activated effectively, such that the back porch signal produced can not transmit to the micro control unit of the capacitive discharge ignition. Since the micro control unit determines the ignition timing of the spark plug based on the back porch signal, when the rotation speed is low and the back porch signal is unstable, engine ignition malfunction may occur and thereby making it difficult to start the engine.

Therefore, an engine ignition control device is required to solve the foregoing deficiencies.

SUMMARY

In order to overcome the deficiencies of the prior art, the present invention provides an engine ignition control device, including: a pulser; and a control unit, which includes a micro control unit (MCU) and a printed circuit board (PCB). The PCB is electrically connected to the micro control unit, wherein the PCB includes a back porch signal generating circuit. The back porch signal generating circuit is electrically connected to the micro control unit, and includes a bipolar junction transistor (BJT). Emitter (E) of the bipolar junction transistor is electrically connected to the pulser, collector (C) of the bipolar junction transistor is electrically connected to the micro control unit, and base (B) of the bipolar junction transistor is increased to a predetermined voltage level that is larger than 0V.

The base (B) of the bipolar junction transistor according to the present invention is increased to a predetermined voltage level; this significantly lowers the trigger voltage of the back porch voltage signal of the pulser. Since the micro control unit determines the ignition timing of the spark plug based on the back porch signal, when under the state of low rotation speed and the temperature is lower than 20 degrees celsius sub-zero, the back porch signal of the ignition control device according to the present invention is stable, thereby preventing the occurrence of engine ignition malfunction and making it easy to start the engine.

In order to better illustrate the foregoing and other objects, features and advantages of the present invention, the preferred embodiment of the present invention will be described hereinafter in detail with reference to the accompanying drawings.

DETAILED DESCRIPTION

Figure 1:
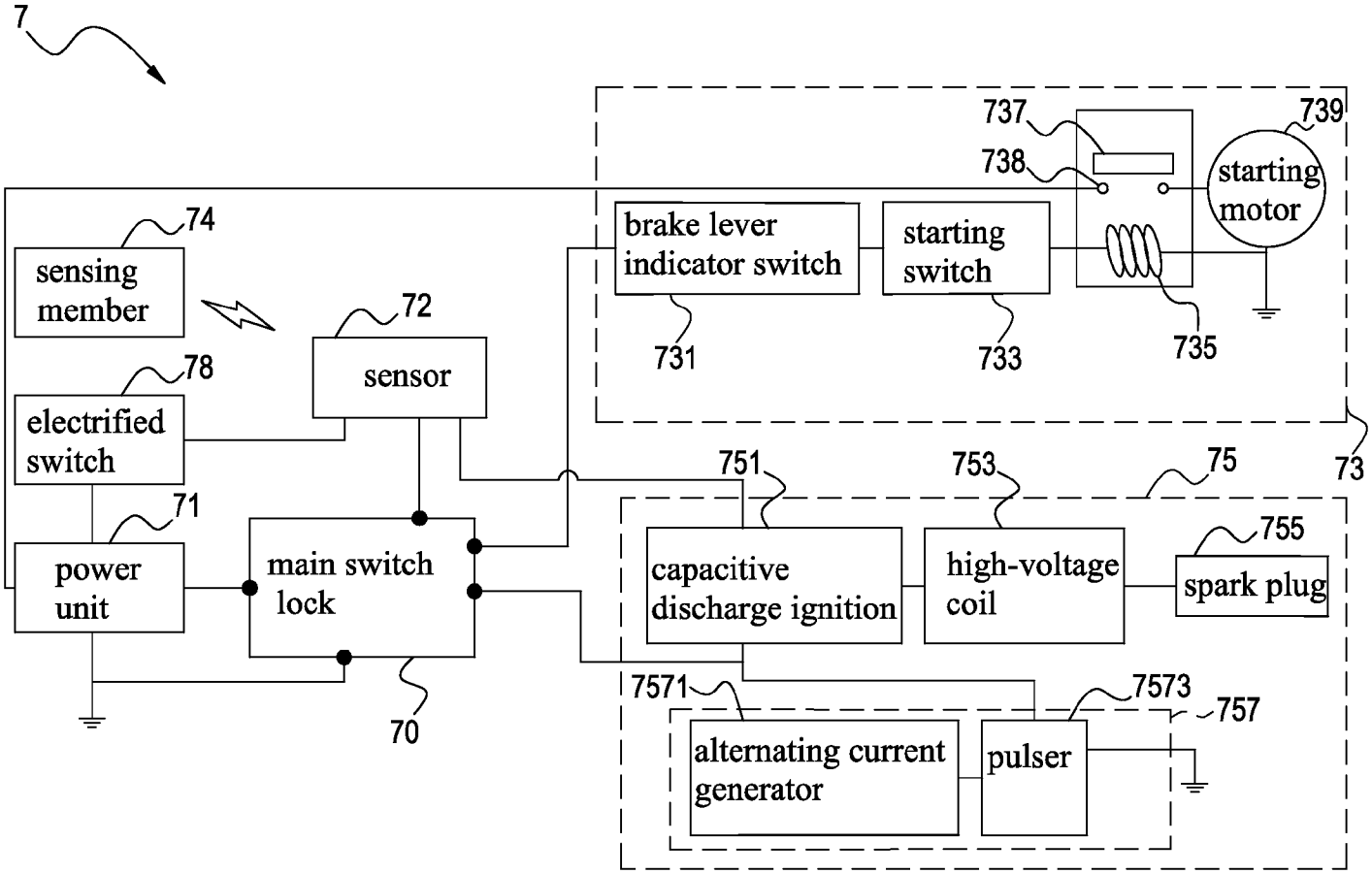
FIG. 1(prior art)
FIG. 1 is a view illustrating an engine starting system according to a prior art.
Figure 2:
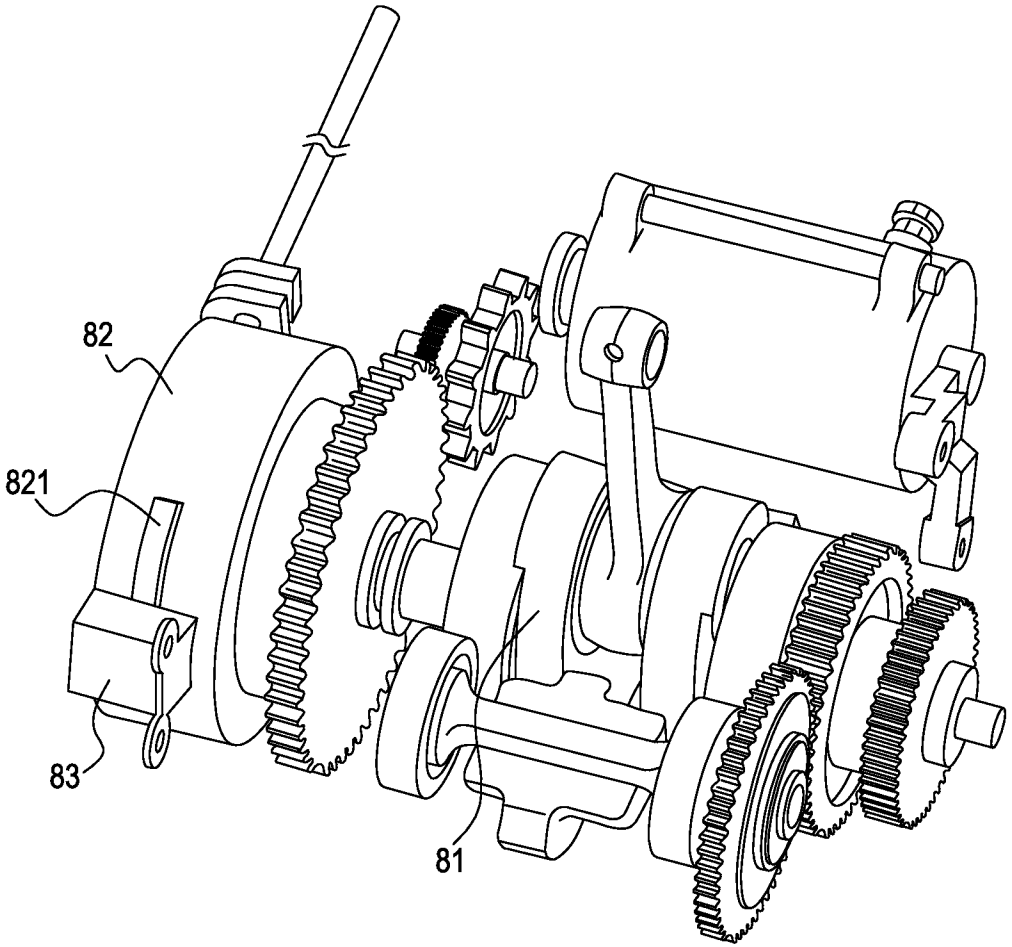
FIG. 2(prior art)
FIG. 2 is a layout view illustrating the crankshaft, flywheel, and pulser according to a prior art.
Figure 3:
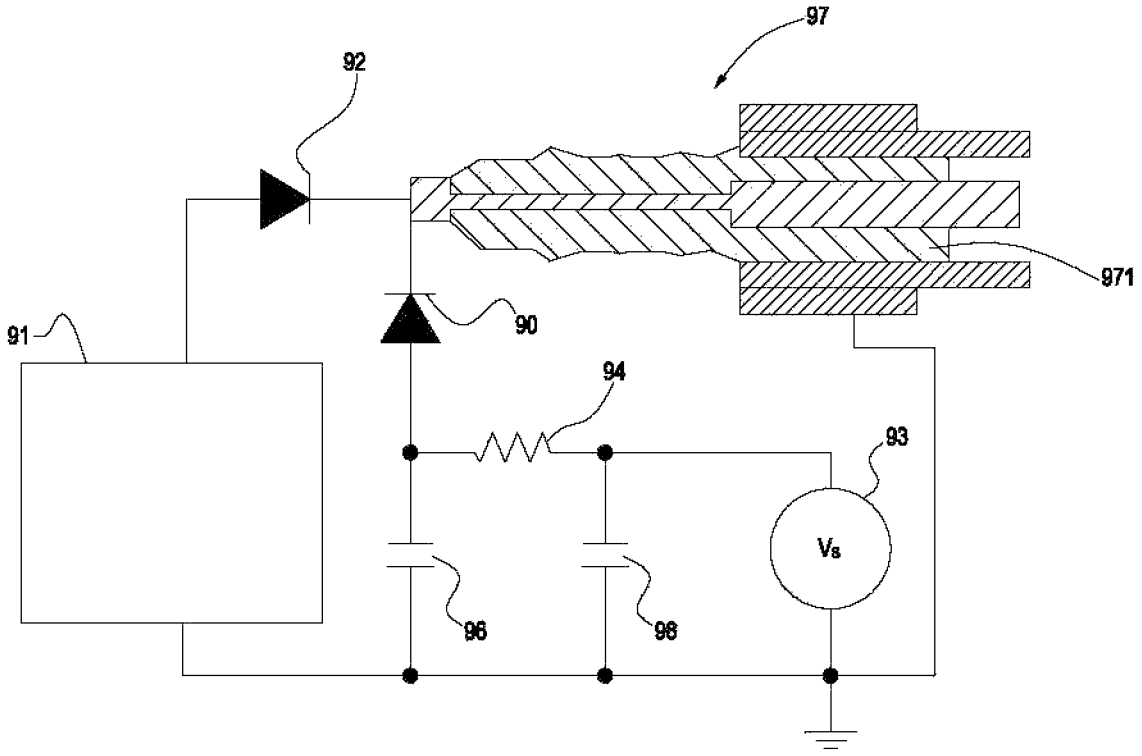
FIG. 3(prior art)
FIG. 3 is a view illustrating an ignition device according to a prior art.
Figure 4:
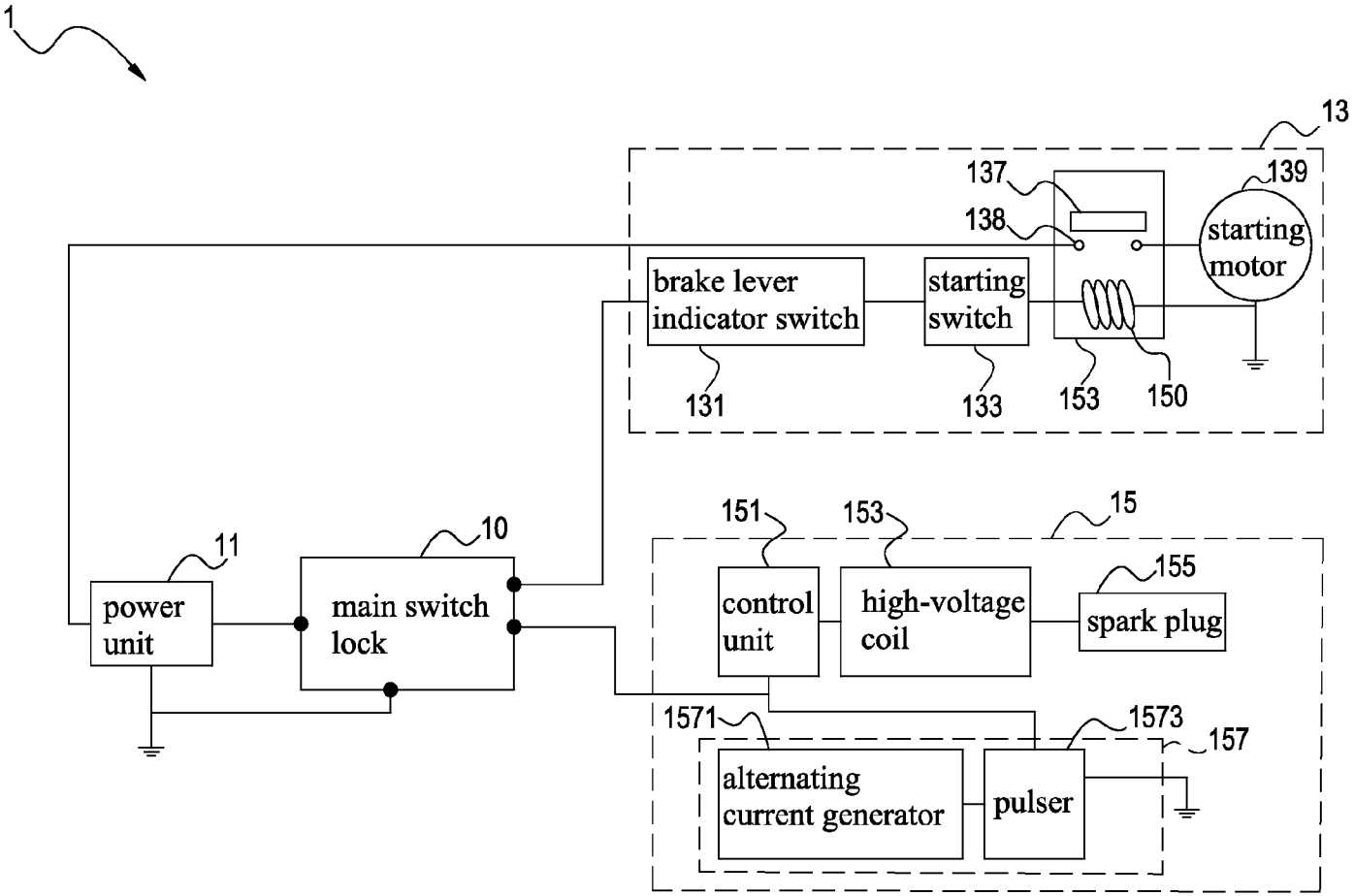
FIG. 4 is a view illustrating an engine starting system according to an embodiment of the present invention.

Referring to FIG. 4, it illustrates an engine starting system 1 according to an embodiment of the present invention. The engine starting system 1 includes a power unit 11, a main switch lock 10, a motor control device 13, and an ignition control device 15. The power unit 11 (such as a storage cell) is used for providing electrical potential and current to the whole engine starting system 1 of the motorcycle. The motor control device 13 is used to drive a crankshaft (not shown) of the engine to rotate, and the ignition control device 15 is used to initiate the spark plug, thereby allowing the engine to continue operate by itself. The main switch lock 10 is electrically connected to the power unit 11, the motor control device 13, and the ignition control device 15; in other words, the main switch lock 10 is used to control the electrical conduction between the power unit 11, the motor control device 13, and the ignition control device 15.

The motor control device 13 includes a brake lever indicator switch 131, a starting switch 133, a relay 137, and a starting motor 139. The excitation coils 135 of the brake lever indicator switch 131, the starting switch 133, and the relay 137 are serially connected to each other. A set of electrical contact points 138 of the relay 137 is electrically connected to the power unit 11 and the starting motor 139. When the brake lever indicator switch 131 and the starting switch 133 are both under conducting state, the excitation coil 135 of the relay 137 is excited, thereby activating the relay 137; whereby, the set of electrical contact points 138 will be under conducting state, allowing the power unit 11 to supply electrical power to the starting motor 139, and thereby allowing the starting motor 139 to rotate, and then driving the crankshaft of the engine to rotate.

The ignition control device 15 includes a control unit 151, a high-voltage coil 153, a spark plug 155, and an ignition signal generator 157. The control unit 151 may be, for example, a capacitive discharge ignition (CDI). The control unit 151, the high-voltage coil 153, and the spark plug 155 are electrically serial-connected to each other, and the ignition signal generator 157 is electrically connected to the control unit 151 in order to control the conducting time of the control unit 151, thereby generating a high voltage from the high-voltage coil 153 and supplying electrical power to the spark plug 155; thus, the spark plug 155 generates an electric arc and is ignited, allowing the engine to continue the rotation by itself. The ignition signal generator 157 includes an alternating current generator (ACG) 1571 and a pulser 1573. The main switch lock 10 controls the electrical conducting state between the power unit 11, the motor control device 13, and the ignition control device 15. When the engine rotates, the alternating current generator 1571 is driven to generate electrical power and transmit the electrical power to the pulser 1573. A voltage signal of the pulser 1573 is then transmitted to the control unit 151, such that the control unit 151 activates base on the voltage signal of the pulser 1573, thereby generating a high voltage from the high-voltage coil 153 and supplying electrical power to the spark plug 155; thus, the spark plug 155 generates an electric arc and is ignited.

Figure 5:
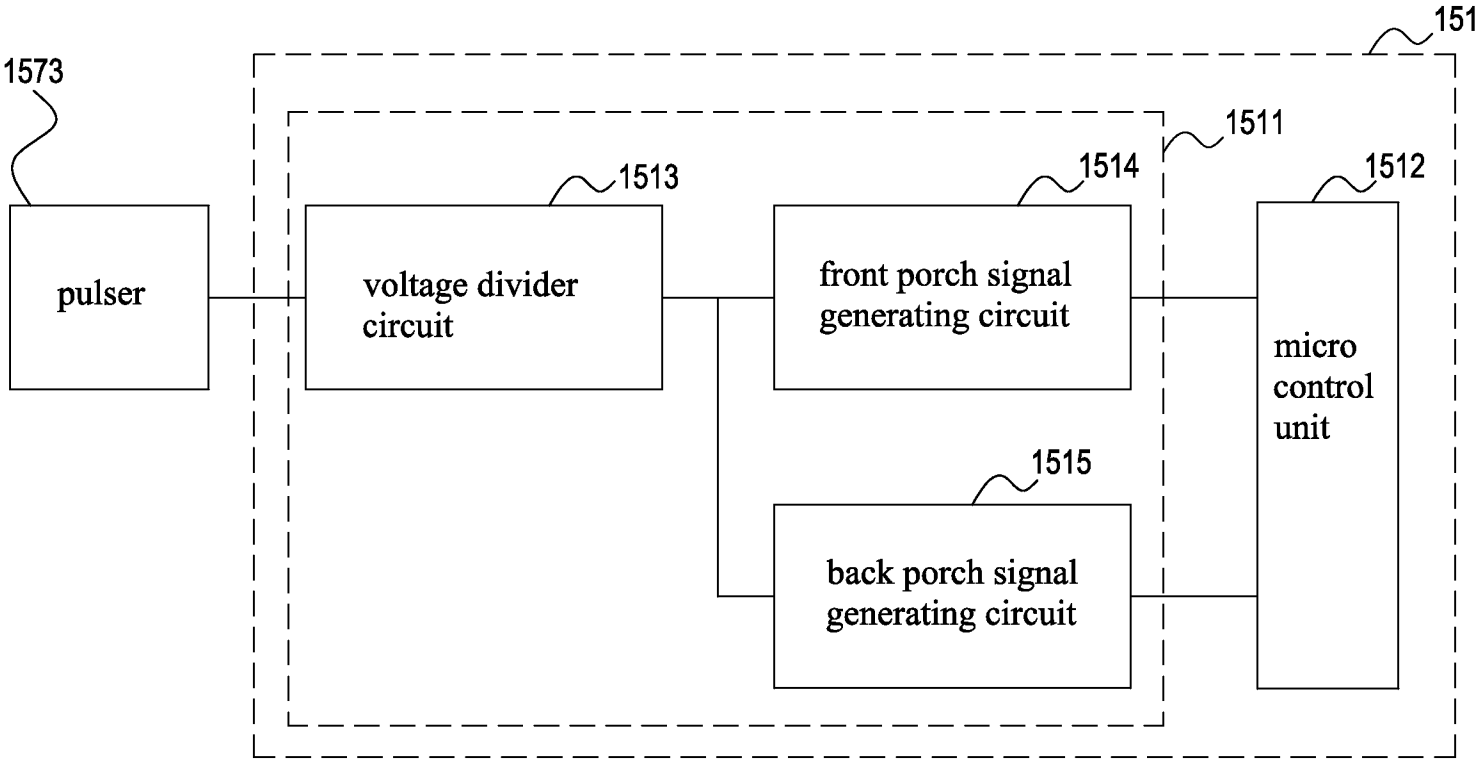
FIG. 5 is a view illustrating the control unit and the pulser according to an embodiment of the present invention.
Figure 6:
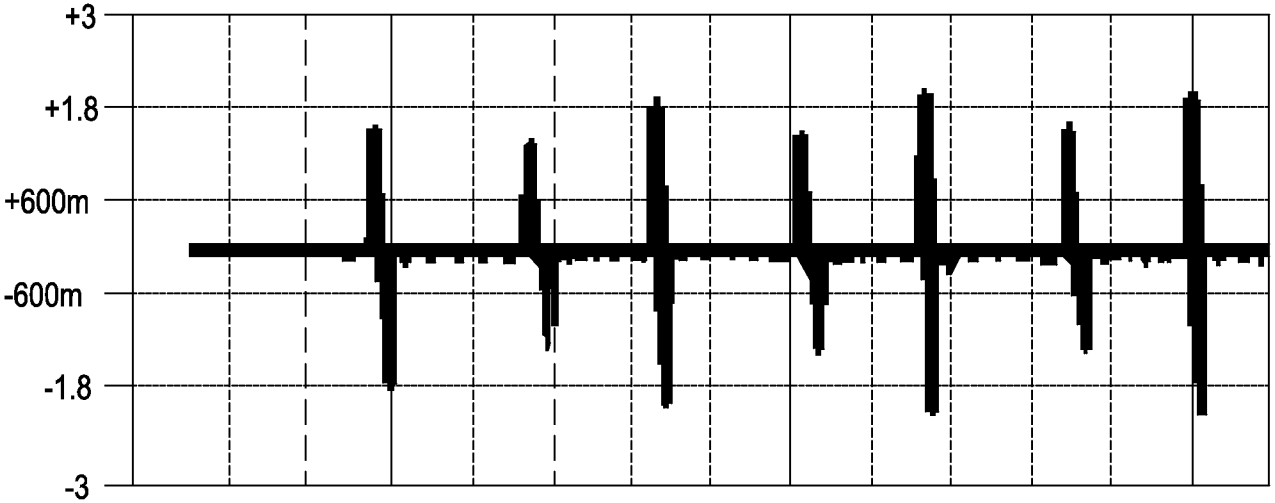
FIG. 6 is a view illustrating voltage signal of the pulser according to an embodiment of the present invention.

Referring to FIG. 5, the control unit 151 includes a micro control unit (MCU) 1512 and a printed circuit board (PCB) 1511. The PCB 1511 may be modular and is electrically connected to the micro control unit 1512. In more detail, the PCB 1511 includes a voltage divider circuit 1513, a front porch signal generating circuit 1514, and a back porch signal generating circuit 1515. The front porch signal generating circuit 1514 is connected in parallel with the back porch signal generating circuit 1515, and then serially connecting with the voltage divider circuit 1513. The voltage divider circuit 1513 is electrically connected to the pulser 1573, and the front porch signal generating circuit 1514 and the back porch signal generating circuit 1515 are electrically connected to the micro control unit 1512, respectively. Referring to FIG. 6, the voltage signal of the pulser 1573 may be a front porch signal positive voltage and a back porch signal negative voltage. In particular, the voltage signal of the pulser 1573 under a low-temperature state (temperature lower than 20 degrees celsius sub-zero) is lower than the voltage signal of the pulser 1573 under normal temperature condition. Further, the back porch voltage of the pulser 1573 is slightly lower than the front porch voltage of the pulser 1573. The voltage divider circuit 1513 is used to stabilize the voltage signal of the pulser 1573, and to convert a sine wave into a square wave. The front porch signal generating circuit 1514 provides the front porch signal to the micro control unit 1512; under the condition of high engine rotation speed, the spark plug may determine ignition according to the provided signal. The back porch signal generating circuit 1515 provides the back porch signal to the micro control unit 1512; under the condition of low engine rotation speed, the spark plug may determine ignition thereof according to the provided signal.

Figure 7:
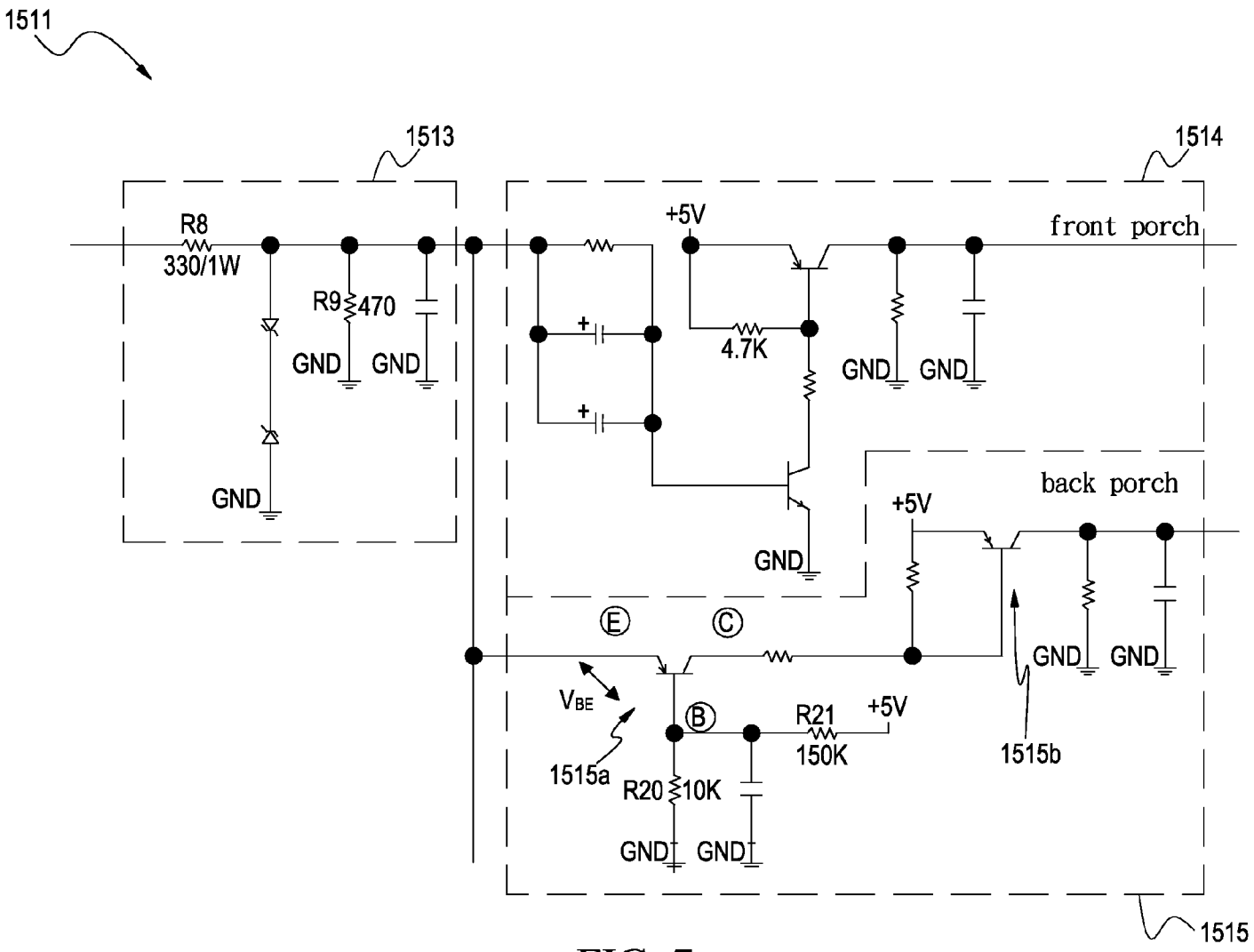
FIG. 7 is a view illustrating a printed circuit board according to an embodiment of the present invention.

Referring to FIG. 7, in the embodiment, the voltage divider circuit 1513 may be consisted of a plurality of electric resistors, capacitors, and voltage dividers. The front porch signal generating circuit 1514 may be consisted of a plurality of electric resistors, capacitors, and bipolar junction transistors (BJTs). The back porch signal generating circuit 1515 may be consisted of a plurality of electric resistors, capacitors, and bipolar junction transistors (BJTs). Layout design of the electronic components (such as electric resistors, capacitors, and bipolar junction transistors) of the voltage divider circuit 1513, the front porch signal generating circuit 1514, and the back porch signal generating circuit 1515 according to FIG. 7 is used to describe the present invention more clearly, not to place limit on the present invention.

In particular, the back porch signal generating circuit 1515 includes a bipolar junction transistor 1515*a*. Emitter (E) of the bipolar junction transistor 1515*a* is electrically connected to the pulser 1573 through the voltage divider circuit 1513. Collector (C) of the bipolar junction transistor 1515*a* is electrically connected to the micro control unit 1512 through another bipolar junction transistor 1515*b*. Base (B) of the bipolar junction transistor 1515*a* is increased to a predetermined voltage level that is larger than 0V.

For example, a voltage regulator integrated circuit (such as #7805) is used to receive a 12V voltage from the power unit, and then convert the 12V voltage down to a 5V voltage. In the embodiment, the 5V voltage is adjusted by electric resistors R20 and R21, setting the base voltage $V_B$ of the bipolar junction transistor 1515*a* to be a predetermined voltage level of 0.3125V. The voltage across the base and emitter ($V_{BE}$) of the bipolar junction transistor 1515*a* has to be at least 0.7V to allow conduction; hence, in order to allow conduction, the emitter voltage $V_E$ has to be larger than 0.387V (negative voltage). Since the voltage signal of the pulser 1573 is lowered after the adjustment made by the electric resistors R8 and R9 of the voltage divider circuit 1513, as long as the voltage signal of the pulser 1573 is larger than 0.651V (negative voltage), the conduction of the bipolar junction transistor 1515*a* may be performed to provide the back porch signal to the micro control unit 1512, and the spark plug may determine ignition of the spark plug under the condition of low engine rotation speed. In particularly, under the condition of low engine rotation speed and low environment temperature (temperature lower than 20 degrees celsius sub-zero), as long as the voltage signal of the pulser 1573 of the present invention is a low voltage, the conduction of the bipolar junction transistor 1515*a* may be performed to provide the back porch signal to the micro control unit 1512, and then the spark plug may determine ignition thereof according to the provided signal.

Comparing to prior art, of which the back porch voltage signal of the pulser has to be larger than 1.2V (negative voltage) to allow conduction of the bipolar junction transistor, the present invention only require the back porch voltage signal of the pulser to be larger than 0.651V (negative voltage) to allow conduction of the bipolar junction transistor. In other words, base (B) of the bipolar junction transistor is increased to a predetermined voltage level; this significantly lowers the trigger voltage of the back porch voltage signal of the pulser. Since the micro control unit determines the ignition timing of the spark plug based on the back porch signal, when under the state of low rotation speed and the temperature is lower than 20 degrees celsius sub-zero, the back porch signal of the ignition control device according to the present invention is stable, thereby preventing the occurrence of engine ignition malfunction and making it easy to start the engine.

The previous description of the preferred embodiment is provided to further describe the present invention, not intended to limit the present invention. Any modification apparent to those skilled in the art according to the disclosure within the scope will be construed as being included in the present invention.

What is claimed is:

1. An engine ignition control device, including:

a pulser; and a control unit, including a micro control unit (MCU) and a printed circuit board (PCB), wherein the PCB is electrically connected to the micro control unit and includes a back porch signal generating circuit, the back porch signal generating circuit is electrically connected to the micro control unit, and includes a bipolar junction transistor (BJT), an emitter (E) of the bipolar junction transistor is electrically connected to the pulser, a collector (C) of the bipolar junction transistor is electrically connected to the micro control unit, and a base (B) of the bipolar junction transistor is increased to a predetermined voltage level that is larger than 0V;

wherein the PCB further includes a voltage divider circuit and a front porch signal generating circuit, the front porch signal generating circuit is connected in parallel with the back porch signal generating circuit, and then serially connecting with the voltage divider circuit, the voltage divider circuit is electrically connected to the pulser, the front porch signal generating circuit is electrically connected to the micro control unit and the emitter (E) of the bipolar junction transistor of the back porch signal generating circuit is electrically connected to the pulser through the voltage divider circuit.

2. The engine ignition control device of claim 1, further includes a voltage regulator integrated circuit to receive a first voltage of a power unit, and then convert the first voltage down to a second voltage lower than the first voltage, wherein, the back porch signal generating circuit further includes two electric resistors, and by the adjustment of the two electric resistors, a base voltage of the bipolar junction transistor is set as the predetermined voltage level.

3. The engine ignition control device of claim 2, wherein under an environment temperature of lower than 20 degrees celsius sub-zero, the first voltage is 12V and the second voltage is 5V, a voltage signal of the pulser larger than 0.651V (negative voltage) allows conduction of the bipolar junction transistor.

4. The engine ignition control device of claim 1, further includes a high-voltage coil, a spark plug, and an ignition signal generator, wherein the control unit, the high-voltage coil and the spark plug are electrically serially-connected to each other, and the ignition signal generator is electrically connected to the control unit.

5. The engine ignition control device of claim 1, wherein a main switch lock is used to control electrical conduction among a power unit, a motor control device, and the engine ignition control device, and transmit the voltage signal of the pulser to the control unit.

* * * * *